US005441134A

United States Patent [19]

Carson

[11] Patent Number: 5,441,134

[45] Date of Patent: Aug. 15, 1995

[54] INSTRUMENT CARRYING CASE

[76] Inventor: Ward Carson, 190 Renouf Ave., Ottawa, Ontario, Canada K1K 3T1

[21] Appl. No.: 249,203

[22] Filed: May 26, 1994

[51] Int. Cl.[6] ..... A45C 3/00

[52] U.S. Cl. ..... 190/111; 190/108; 206/314

[58] Field of Search ..... 206/14, 314, 372, 373; 190/108, 109, 111, 113, 112, 115, 117; 220/757, 764, 768, 770

[56] References Cited

U.S. PATENT DOCUMENTS

| | | | |
|---|---|---|---|
| 270,640 | 1/1883 | Cundy | 206/314 |
| 1,541,895 | 6/1925 | Blair | 206/14 |
| 3,191,765 | 6/1965 | Dozier | 206/273 |
| 4,117,914 | 10/1978 | Snyder | 190/108 |
| 4,531,632 | 7/1985 | Weber | 206/14 |
| 4,738,340 | 4/1988 | Crespi | 190/111 |
| 4,765,457 | 8/1988 | Rayhle | 206/372 |

FOREIGN PATENT DOCUMENTS

| | | | |
|---|---|---|---|
| 832473 | 9/1938 | France | 206/373 |
| 621924 | 4/1949 | United Kingdom | 190/108 |
| 867548 | 5/1961 | United Kingdom | 190/112 |
| 2051743 | 1/1981 | United Kingdom | 206/273 |
| 9008631 | 8/1990 | WIPO | 190/112 |

*Primary Examiner*—David T. Fidei
*Attorney, Agent, or Firm*—Kent & Edgar

[57] ABSTRACT

An instrument carrying case comprising a lid for opening the case to an instrument receiving chamber within. The improvement is characterized in that a second case is provided secured to the first and having a chamber separate from the chamber of the carrying case, and access means being provided for the chamber of the second case other than through the chamber of the carrying case.

6 Claims, 2 Drawing Sheets

INSTRUMENT CARRYING CASE

BACKGROUND OF THE INVENTION

The present invention relates to an instrument carrying case and more particularly to such a case which is particularly adapted to carrying a musician's accessories such as music and music stands.

Conventionally instrument carrying cases for musical instruments, such as violins, clarinets, guitars and the like, comprise an instrument receiving chamber and a lid, usually hinged to a side of the case, for opening the case to the chamber within so that the instrument can be removed or placed therein. Often such cases have an interior compartment with a flap or other such lid which opens, from a portion of the chamber, to receive accessories such as picks, tuners or the like.

Patents of background interest teaching musical instrument carrying cases having compartments within the instrument carrying case include U.S. Pat. No. 2,156,910 of Brooks issued May 2, 1939, U.S. Pat. No. 3,901,384, of Lee et al issued Aug. 26, 1975, and U.S. Pat. No. 4,433,781 of Hummel issued Feb. 8, 1984. Other instrument carrying cases of general background interest as containing instrument supports or converting thereto are U.S. Pat. No. 4,147,254 of Bruce issued Apr. 3, 1979, and U.S. Pat. No. 1,986,703 of Baker et al issued Jan. 1, 1935.

U.S. Pat. No. 5,248,030 of Tarozzi issued Sep. 18, 1993 describes and illustrates a foldable instrument container for writing, drawing or painting instruments.

A violin carrying case having a deepened chamber for holding, for example, excess bows, access to which is gained by removing an upper partition on which the violin itself is normally seated, is also known in the prior art.

It is an object of the present invention to provide an instrument carrying case which will effectively and efficiently carry accessories of a musician, including bulky accessories such is music sheets and books and music stands. It is a further object of the present invention to provide such a case having extra space for such accessories, which space is accessible other than through the main compartment where the musical instrument is normally stored.

SUMMARY OF THE INVENTION

The present invention relates to an instrument carrying case which comprises a lid for opening the case to an instrument receiving chamber within. The improvement is characterized in that a second case is provided secured to the first and having a chamber separate from the chamber of the carrying case, and access means being provided for the chamber of the second case other than through the chamber of the carrying case.

In the preferred embodiment the second case is hingedly secured to the carrying case in a manner so that the carrying case acts as a lid for the chamber of the second case.

In the alternative embodiment, the second chamber comprises a slidable drawer in a side of the second case.

The instrument carrying case of the present invention provides a simple and effective means for carrying, in conjunction with the musical instrument carrying case, bulkier accessories such as music stands and musical books, which previously have had to be carried independently and separately from the case itself. It is an important aspect of the present invention that access to the chamber of the second case is provided not through the chamber of the first case, but independently thereof.

BRIEF DESCRIPTION OF THE DRAWINGS

These and other objects and advantages of the invention will become apparent upon reading the following detailed description and upon referring to the drawings in which.

Figure 1:
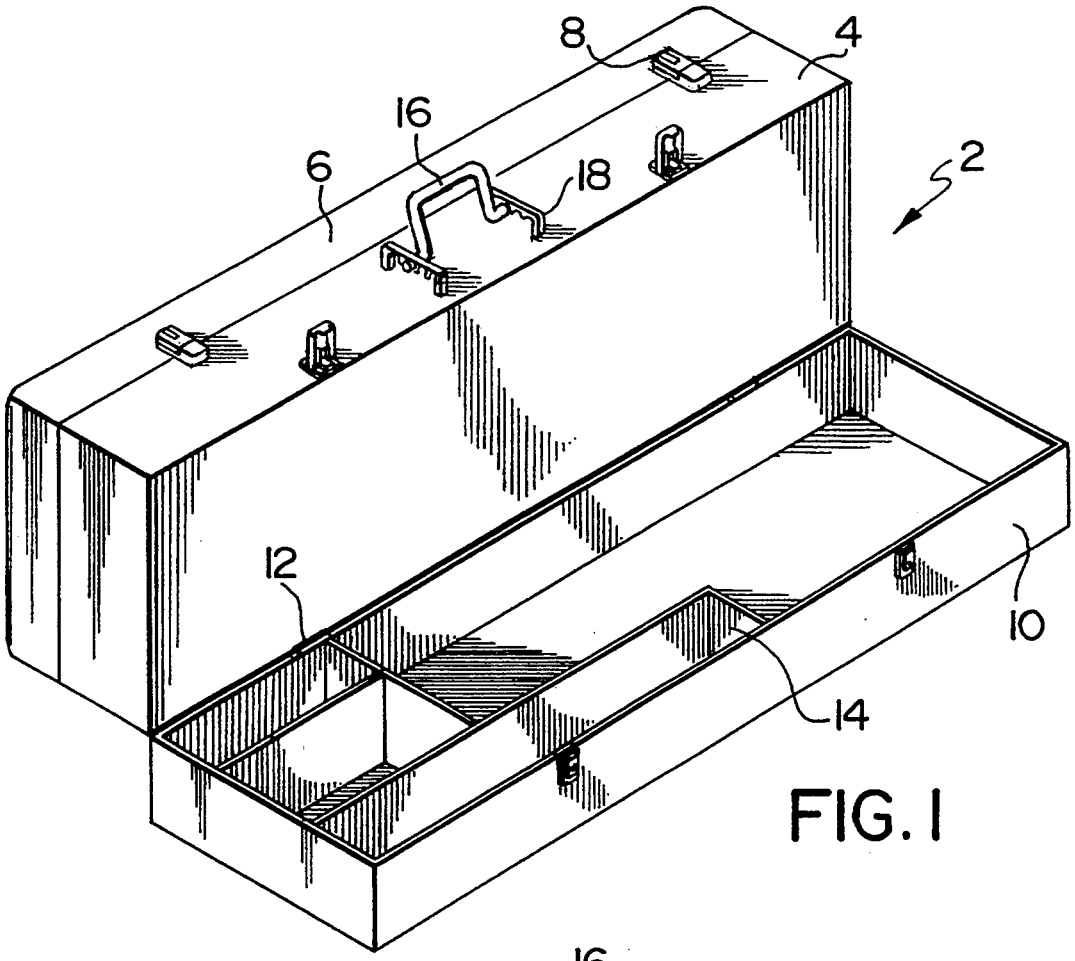
FIG. 1 is a perspective view of an example embodiment of an instrument carrying case in accordance with the present invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the drawings, similar features have been given similar reference numerals.

Turning to FIG. 1 there is illustrated an instrument carrying case 2 in accordance with the present invention, particularly suited, for example for a violin. To a conventional carrying case 4, having a lid 6 which is hingedly secured thereto to open to a compartment containing holding compartment within and is held shut by appropriate snap claps 8, a second case 10 is secured thereto by means of hinges 12. The chamber within second case 10 is preferably appropriately partitioned with wall sections 14, and of sufficient size, to securely hold and carry for example music binder, music stands, and other musicians' accessories. If desired, hinges 12 may be such as to be releasable from case 4 with an appropriate lid or cover (not illustrated) being provided for case 10 when thus detached from case 4.

Figure 2:
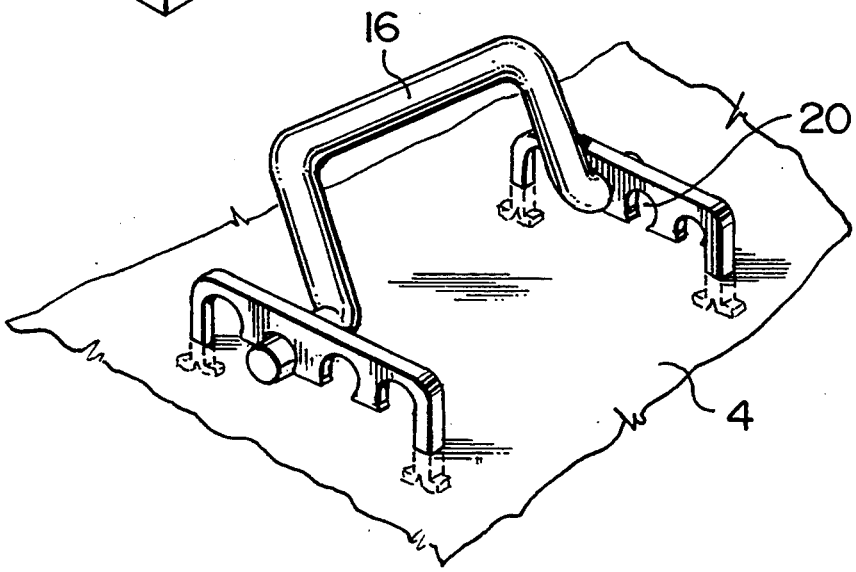
FIG. 2 is an enlarged partial view of the carrying case of FIG. 1 illustrating an adjustable handle mechanism thereof in more detail.

As can be seen in FIG. 2, a handle 16 for case 4 may be adjustable by its being appropriately positioned in adjustable side pieces 18. This permits the case to be balanced while being carried, no matter what the configuration or weight load in the case or cases. The ends of handle 16 for example may be snap fit into appropriate ones of the receiving spaces 20 in side pieces 18.

Figure 3:
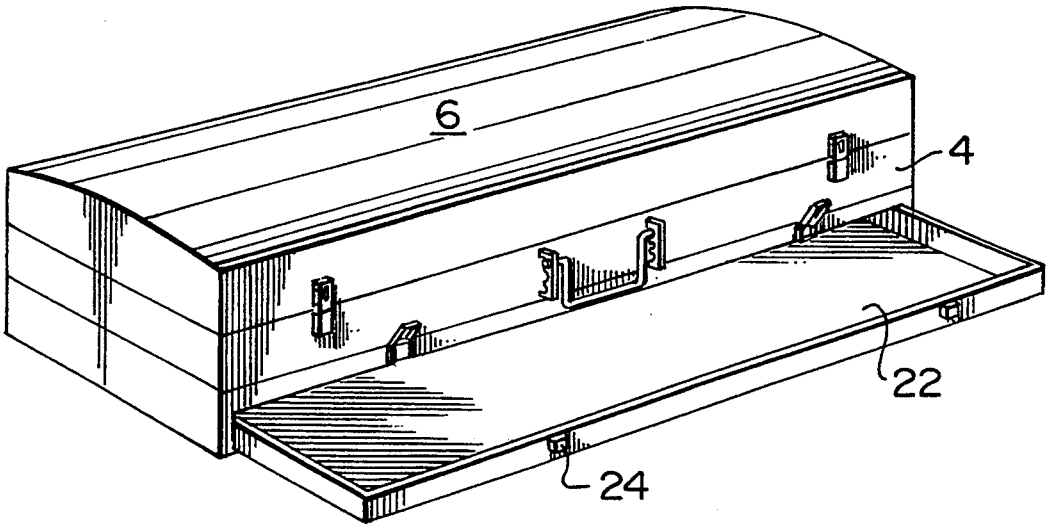
FIG. 3 is a perspective view of an alternative embodiment of an instrument carrying case in accordance with the present invention.

In the alternative embodiment of case illustrated in FIG. 3, a drawer 22 is slidably positioned within second case 10, drawer 22 adapted to receive and hold appropriate accessories such as the musicians' music and music stand and other accessories. Appropriate snap clasps or other locking mechanisms 24 may be provided to secure drawer 22 in closed position while the carrying case is being transported.

Figure 4:
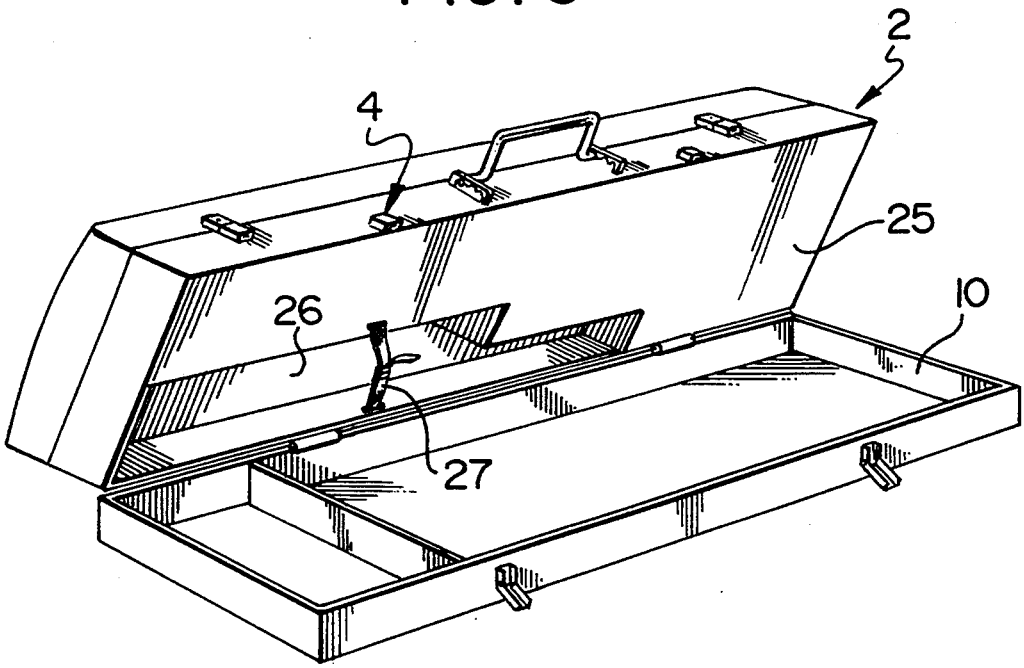
FIG. 4 is a perspective view of a further alternative embodiment of the present invention.

A further embodiment of the present invention is illustrated in FIG. 4, where the floor 25 of the case is itself recessed upwardly at 26, as illustrated, so that a bulkier item, such as a music stand, can be received in the recess, being held in position therefore for example by an appropriate securing means such as a strap 17.

Recess 26 extends upwardly into the chamber of case 4, but in such a way so as not to obstruct or interfere with the positioning of the musical instrument within that chamber. The advantage of this embodiment is that the actual depth of the second case can be reduced, since accommodation does not have to be made within that second case alone, for such bulky items.

It will be understood that the carrying case according to the present invention provides an extremely simple and effective means of carrying a musicians' accessories together with that person's instrument, in a single case construction. Access to the accessories is gained independently of access to the musical instrument.

Thus it is apparent that there has been provided an improved instrument carrying case in accordance with the invention that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my Invention:

1. In an instrument carrying case having an instrument receiving chamber within, the case comprising a lid for opening the case, the improvement characterized in that a second case is provided secured to the carrying case and having a chamber separate from the chamber of the carrying case, and means being provided for accessing the chamber of the second case, for inserting an object into or removing it from the chamber of the second case, other than through the chamber of the carrying case, and a recess is provided in the chamber of the second case extending into the chamber of the first case, whereby items may be received and stored in that recess so as to be accessible from the second case.

2. A carrying case according to claim 1 wherein the second case is hingedly secured to the carrying case in a manner so that the carrying case acts as a lid for the chamber of the second case.

3. A carrying case according to claim 1 wherein the chamber of the second case is provided with means for partitioning the chamber into distinctive areas.

4. A case according to claim 1 further provided with a handle releasably adjustably securable to receiving means secured to the carrying case to permit adjusting the location of the handle on the carrying case.

5. An instrument carrying case according to claim 2 adapted to carry a violin within the instrument receiving chamber and having a hinged lid for opening the case to remove or insert the violin, and the second case being hingedly secured to the carrying case, the chamber of the second case being of a size and contour to receive and carry a music stand and music binder or book.

6. An instrument carrying case according to claim 1 wherein the second case is secured to the instrument carrying case by releasable securing means.

* * * * *